United States Patent [19]

Bishop

[11] Patent Number: 4,966,688

[45] Date of Patent: Oct. 30, 1990

[54] ORE FLOTATION EMPLOYING AMINO MERCAPTOTHIADIAZOLES

[75] Inventor: M. D. Bishop, Bartlesville, Okla.

[73] Assignee: Phillips Petroleum Company, Bartlesville, Okla.

[21] Appl. No.: 210,888

[22] Filed: Jun. 23, 1988

[51] Int. Cl.[5] ..... B03D 1/01; B03D 1/012

[52] U.S. Cl. ..... 209/167; 209/166; 252/61

[58] Field of Search ..... 209/166, 167; 252/61; 45/97 R; 75/115

[56] References Cited

U.S. PATENT DOCUMENTS

| | | | |
|---|---|---|---|
| 1,807,860 | 6/1931 | Moses | 209/166 |
| 1,825,501 | 9/1931 | Barsky et al. | 209/166 |
| 1,852,108 | 4/1932 | Christmann et al. | 209/166 |
| 1,894,344 | 1/1933 | Christmann et al. | 209/166 |
| 3,449,365 | 6/1969 | Lies | 260/327 |
| 3,469,692 | 9/1969 | Freyberger | 209/166 |
| 3,494,758 | 2/1970 | Kopp et al. | 71/67 |
| 3,784,454 | 1/1974 | Lyde | 204/52 R |
| 4,022,686 | 5/1977 | Arakatsu et al. | 209/166 |
| 4,107,168 | 8/1978 | Okorodudu | 260/302 E |
| 4,357,396 | 11/1982 | Grunewalder et al. | 428/626 |
| 4,514,293 | 4/1985 | Bresson et al. | 209/167 |
| 4,515,687 | 5/1985 | Bresson et al. | 209/167 |
| 4,533,467 | 8/1985 | Kimble et al. | 209/167 |
| 4,857,179 | 8/1989 | Kimble et al. | 209/166 |
| 4,877,518 | 10/1989 | Bresson | 209/167 |

FOREIGN PATENT DOCUMENTS

| | | | |
|---|---|---|---|
| 1182461 | 2/1985 | Canada | 260/308.3 |
| 314822 | 7/1929 | United Kingdom | 209/166 |

OTHER PUBLICATIONS

Chemical Abstract 86:30341e.

R. T. Vanderbilt Company, Inc., Technical Data VCM-DMTD-1A/8306 (8210).

R. T. Vanderbilt Company, Inc., VCM-NAT-D-1A/8303 (8204), Technical Data.

Olin Chemicals Brochures (Hydrozine-the Versatile Reactant; Hydrozine Derivatives), Olin Chemicals Advertizement-*Chemical & Engineering News*, Aug. 22, 1983, p. 4.

Flotation Fundamentals and Mining Chemicals by Dow Chemicals; p. 7 (1968), or (1970).

Mining Chemicals Handbook [Mineral Dressing Note No. 26], by Cyanamid of Canada; p. 65 (1976).

Section on Flotation of the Encyclopedia of Chemical Technology, vol. 10 (3 ed.), pp. 523, 531-532 and 536-537 (1980).

*Primary Examiner*—Theodore Morris

*Assistant Examiner*—Paige C. Harvey

*Attorney, Agent, or Firm*—John M. Fish, Jr.; Archie L. Robbins

[57] ABSTRACT

A process for separating and recovering minerals, such as molybdenum or graphite, from ores with which they occur by addition of an amino mercaptothiadiazole to an ore flotation process.

20 Claims, No Drawings

ORE FLOTATION EMPLOYING AMINO MERCAPTOTHIADIAZOLES

BACKGROUND OF INVENTION

The present invention relates generally to flotation processes for recovering desired minerals from ores containing those minerals. In another aspect, this invention relates to a process wherein sulfide minerals are separated from other sulfide minerals with which they occur by addition of an amino mercaptothiadiazole to an ore flotation process.

Flotation processes are known in the art and are used for concentrating and recovering minerals from ores. In froth flotation processes, the ore is crushed and wet ground to obtain a pulp. Additives such as mineral flotation or collecting agents, frothers, depressants, and stabilizers are added to the pulp to assist separating valuable materials from undesirable or gangue portions of the ore in subsequent flotation steps. The pulp is then aerated to produce a froth at the surface. The minerals which adhere to the bubbles or froth are skimmed or otherwise removed and the mineral bearing froth is collected and further processed to obtain the desired minerals. Typical mineral flotation collectors include xanthates, amines, alkyl sulfates, arene sulfonates, dithiocarbamates, dithiophosphates, and thiols. Frequently, other chemicals are added to the separated mineral-bearing froth to assist in subsequent separations particularly when significant proportions of two or more minerals are present in the separated mineral-bearing froth. Such chemicals are known as depressants. These materials are used to selectively separate one type of mineral from another type of mineral.

While the art of ore flotation has reached a significant degree of sophistication, it is a continuing goal in the ore recovery industry to increase the productivity of ore flotation processes and above all to provide specific processes which are selective to one ore or to one mineral over other ores or other minerals, respectively, which are present in the treated material.

SUMMARY OF THE INVENTION

It is the object of the present invention to provide an improved process for recovering desired minerals from ores containing such minerals.

It is also the object of this invention to provide a process for recovery of molybdenum from ores in which it occurs.

It is another object of this invention to provide a process for recovery of graphite from other minerals with which it occurs.

It is still another object of this invention to provide a process for recovery of molybdenum from the metallurgical concentrates in which it occurs.

In accordance with this invention, it has now been found that amino mercaptothiadiazoles are very effective in the recovery of desired minerals from ores containing those minerals in ore flotation processes. In one more specific embodiment of this invention, a process is provided for the recovery of molybdenum from the ore in which it occurs by the addition of an amino mercaptothiadiazole in an ore flotation process.

In a second embodiment of this invention, a process is provided for the recovery of graphite from other minerals with which it occurs by the addition of an amino mercaptothiadiazole in an ore flotation process.

In a third embodiment of this invention, a process is provided for the recovery of molybdenum from a metallurgical concentrate obtained in a first flotation step by the addition of an amino mercaptothiadiazole in subsequent flotation steps in a flotation process.

DETAILED DESCRIPTION OF THE INVENTION

In accordance with the present invention, there is provided a process for recovering at least one desired mineral from a mineral ore containing the at least one desired mineral. The ore flotation process of this invention distinguishes over the known ore flotation processes primarily in the employment of a new treating agent to be defined. The flotation process comprises carrying out a mineral flotation with a treating agent present, wherein the treating agent is an amino mercaptothiadiazole having the formula:

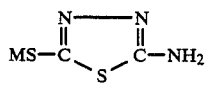

wherein M is selected from the group consisting of hydrogen and alkali metal atoms.

Generally, the flotation process will utilize a composition comprising the amino mercaptothiadiazole, water, and the mineral material. The treating agent of the present invention can be used to depress copper sulfides in the presence of molybdenum. The recovery of other mineral sulfides, such as those based on Pb, Fe, Zn, Ni, Sb, etc., are considered within the scope of this invention. In ores, the metals are usually in a solid sulfided state and form a slurry, which can be finely divided, as in a pulp. For example, the invention can be employed to process an ore slurry containing high copper values. The invention can also be employed to process a concentrate, such as a concentrate which contains high molybdenum values. Exemplary ores include the following:

| | |
|---|---|
| Molybdenum-Bearing Ores | |
| Molybdenum | $MoS_2$ |
| Wulfenite | $PbMoO_4$ |
| Powellite | $Ca(MO,W)O_4$ |
| Ferrimolybdite | $Fe_2Mo_3O_{12}.8H_2O$ |
| Copper-Bearing Ores | |
| Covallite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valerite | $Cu_2Fe_4S_7$ or $Cu_3Fe_4S_7$ |
| Enargite | $Cu_3(As,Sb)S_4$ |
| Tetrahedrite | $Cu_3SbS_2$ |
| Tennanite | $Cu_{12}As_4S$ |
| Stannite | $Cu_2S.FeS.SnS_2$ |
| Bournonite | $PbCuSbS_3$ |
| Leading-Bearing Ore | |
| Galena | $PbS$ |
| Antimony-Bearing Ore | |
| Stibnite | $Sb_2S_3$ |
| Kermesite | $Sb_2S_2O$ |
| Zinc-Bearing Ore | |
| Sphalerite | $ZnS$ |
| Silver-Bearing Ore | |
| Argentite | $Ag_2S$ |
| Stephanite | $Ag_5SbS_4$ |
| Polybasite | $9Ag_2S.Sb_2S_3$ |
| Iron-Bearing Ore | |
| Pyrite | $FeS_2$ |

-continued

| | |
|---|---|
| Pyrrohotite | $Fe_5S_6$ to $Fe_{16}S_{17}$ |
| Arsenopyrite | FeAsS |
| Marmatite | (ZnFe)S |
| Nickel-Bearing Ore | |
| Millerite | NiS |
| Pentlandite | (FeNi)S |
| Ullmannite | NiSbS |

Generally, the solids to be processed will be present as a slurry in water which contains the treating agent, with the treating agent being present in an amount of about 0.01 to about 20 pounds per ton of the solids. The slurry usually contains between about 10 and 75 percent solids preferably in the range of 15-60 weight percent solids, depending on the processing stage. Preferably, the amino mercaptothiadiazole is present in the composition in an amount in the range of about 0.01 to about 3 pounds per ton of solids. Even more preferably, the amino mercaptothiadiazole is present in an amount in the range of about 0.04 to about 2 pounds per ton of the solids. The preferred amino mercaptothiadiazole is 2-amino-5-mercapto-1,3,4-thiadiazole. The flotation process usually involves the steps of:

(a) mixing crushed or ground mineral material with water and the treating agent defined above to establish a pulp, (b) aerating the pulp to produce a froth and a pulp, (c) separating the froth from the pulp and producing a concentrate product and a tail product, and (d) recovering minerals from the so separated concentrate and/or tail product.

Recovery after additional flotation and frothing steps is optional. In the method of the present invention, the treating agent may be added to the concentrate obtained from a first flotation step and the concentrate then subjected to a subsequent flotation step. The desired minerals may then be recovered from the resulting concentrate and/or tail.

Mineral flotation or collecting agents, frothers, and stabilizers can also be used in the various steps.

The inventive depressant can be used together with other depressants or depression steps if desired. For example, the depressant composition defined above can be used with additional depressants, such as sodium cyanide, sodium ferrocyanide, lime and zinc sulfate, in the treatment of an ore.

Any froth flotation apparatus can be used in this invention. The most commonly used commercial flotation machines are the Agitair (Galigher Co.), Denver D-12 (Denver Equipment Co.), and the Fagergren (Western Machinery Co.).

The instant invention was demonstrated in tests conducted at ambient room temperature and atmospheric pressure. However, any temperature or pressure generally employed by those skilled in the art is within the scope of this invention.

EXAMPLE

This example shows the effectiveness of 2-amino-5-mercapto- 1,3,4-thiadiazole as a copper sulfide and iron sulfide depressant using three different methods of addition of the depressant composition. In a rod mill, 1000 g of a molybdenum bearing ore (Morenci, Oreg.), 800 ml water, 1.67g lime and 0.05 lbs of 2-amino-5-mercapto-1,3,4-thiadiazole per ton of ore were ground for 5 minutes to obtain a pulp. The pulp was conditioned for 1 minute at 1950 rpm after addition of 0.13 lb/ton Frother F2X (30% isopherone, 70% Kodak 750) and floated 5 minutes at a pH of 10.5 in a Denver D12, 2.5 liter cell. The depressant was added to the grind in run number 1 as a dry powder (.025g), in run number 2 as a 0.5% solution (with 3 drops 50% NaOH solution to 25 ml water.), and in run number 3 as a 0.5% solution but with no lime added to the grind. The percent average recovery of molybdendum, copper, and iron are shown in the following table.

TABLE

Effect of 2-amino-5-mercapto-1,3,4,thiadiazole, as a Cu and Fe Depressant in Mo Ore Flotation

| | Conc. | % Recovery | | | Calculated Heads** | | |
|---|---|---|---|---|---|---|---|
| Run | lb/ton* | Cu | Fe | Mo | Cu | Fe | Mo |
| 1 | .05 | 15.08 | 5.41 | 44.08 | 0.435 | 3.050 | 0.0089 |
| 2 | .05 | 21.22 | 9.23 | 48.18 | 0.433 | 2.848 | 0.0091 |
| 3 | .05 | 28.73 | 8.81 | 39.25 | 0.420 | 2.871 | 0.0084 |

*Pounds of chemical per ton of ore

**Amount of Cu, Fe, and Mo in ore

As can be seen from this table a much larger percent of Mo was recovered compared to either Cu or Fe. 2-amino-5-mercapto-1,3,4-thiadiazole is therefore an effective depressant for copper as well as iron in the presence of molybdenum.

While this invention has been described in detail for the purpose of illustration, it is not to be construed as limited thereby but is intended to cover all changes and modifications within the spirit and scope thereof.

What is claimed is:

1. A process for recovery of minerals comprising:

(a) mixing ore, which has been sufficiently crushed for use in an ore flotation process, containing said minerals, water, and a sufficient amount of an amino mercaptothiadiazole to depress a portion of said minerals, said amino mercaptothiadiazole having the formula:

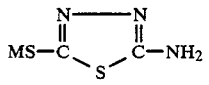

wherein M is selected from the group consisting of hydrogen and alkali metal atoms, to establish a pulp;

(b) aerating said pulp to produce a froth containing a concentrate portion of said minerals while allowing a tail portion of said minerals to be depressed in said pulp; and (c) recovering said concentrate portion from said froth and recovering said tail portion of said minerals from said pulp.

2. A process according to claim 1 wherein M is hydrogen.

3. A process according to claim 1 wherein M is sodium.

4. A process according to claim 1 wherein the amount of the amino mercaptothiadiazole employed is within the range from about 0.01 to about 20 lb/ton of ore.

5. A process according to claim 1 wherein the amount of the amino mercaptothiadiazole employed is within the range from about 0.01 to about 3 lb/ton of ore.

6. A process according to claim 1 wherein the amount of the amino mercaptothiadiazole employed is within the range from about 0.04 to about 2 lb/ton of ore.

7. A process according to claim 1 wherein said concentrate portion of said minerals comprises a molybdenum compound.

8. A process according to claim 1 wherein said concentrate portion of said minerals comprises graphite.

9. A process according to claim 1 wherein said tail portion of said minerals comprises one or more minerals selected from the group consisting of copper sulfide and iron sulfide minerals.

10. A process for the recovery of molybdenum comprising:

(a) mixing ore, which has been sufficiently crushed for use in an ore flotation process, containing a molybdenum compound, water, and 2-amino-5mercapto-1,3,4-thiadiazole in an amount from about 0.04 to about 2 lb/ton of ore or concentrate to establish a pulp;

(b) aerating said pulp to produce a froth containing a molybdenum compound while allowing copper sulfide and iron sulfide to be depressed in said pulp; and (c) recovering said molybdenum compound from said froth and recovering said depressed copper sulfide and iron sulfide from said pulp.

11. A process for the recovery of minerals comprising:

(a) mixing ore, which has been sufficiently crushed for use in ore flotation process, containing said minerals and water to establish a pulp;

(b) subjecting said pulp to flotation wherein said pulp is aerated to produce a froth containing concentrated minerals;

(c)

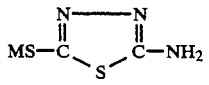

recovering said froth and converting said froth into a subsequent pulp containing said concentrated minerals;

(d) contacting said subsequent pulp with a sufficient amount of an amino mercaptothiadiazole to depress a first portion of said concentrated minerals present in said subsequent pulp, said amino mercaptothiadiazole having the formula;

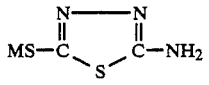

wherein M is selected from the group consisting of hydrogen and alkali metal atoms;

(e) aerating said contacted subsequent pulp to produce a resultant pulp and a subsequent froth, said subsequent froth containing a second portion of said concentrated minerals while allowing said first portion of said concentrated minerals to be depressed in said resultant pulp; and (f) recovering said second portion of said concentrated minerals from said subsequent froth.

12. A process according to claim 11 wherein M is hydrogen.

13. A process according to claim 11 wherein M is sodium.

14. A process according to claim 11 wherein the amount of the amino mercaptothiadiazole employed is within the range from about 0.01 to about 20 lb/ton of concentrate.

15. A process according to claim 11 wherein the amount of the amino mercaptothiadiazole employed is within the range from about 0.01 to about 3 lb/ton of concentrate.

16. A process according to claim 11 wherein the amount of the amino mercaptothiadiazole employed is within the range from about 0.04 to about 2 lb/ton of concentrate.

17. A process according to claim 11 wherein said first portion of said minerals comprises a molybdenum compound.

18. A process according to claim 11 wherein said first portion of said minerals comprises graphite.

19. A process according to claim 11 wherein said second portion of said minerals comprises one or more minerals selected from the group of copper sulfide and iron sulfide minerals.

20. A process according to claim 11 wherein said concentrated minerals contain a molybdenum compound, and said amino mercaptothiadiazole is 2-amino-5mercapto-1,3,4-thiadiazole and is introduced in the range of from about 0.04 to about 2 lb/ton of concentrated minerals, and wherein said process further comprises:

(g) a further aerating said first portion of said concentrated minerals to produce a third froth containing said molybdenum compound while allowing minerals selected from the group consisting of copper sulfide and iron sulfide to be depressed in said resultant pulp; and (h) recovering said molybdenum compound from said third froth and recovering said depressed minerals from said resultant pulp.

* * * * *

UNITED STATES PATENT AND TRADEMARK OFFICE

CERTIFICATE OF CORRECTION

PATENT NO. : 4,966,688

DATED : October 30, 1990

INVENTOR(S) : Marshall D. Bishop

It is certified that error appears in the above-identified patent and that said Letters Patent is hereby corrected as shown below:

In Claim 10, column 5, line 18, after "5" and before "mercapto", insert -.

In column 5, please delete the formula found in subparagraph (c).

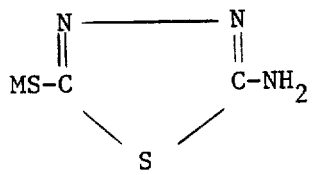

In Claim 11, column 5, line 57, after "formula", delete ";" and insert :.

In Claim 20, column 6, line 45, after "5" and before "mercapto",insert -.

Signed and Sealed this

Seventeenth Day of March, 1992

*Attest:*

HARRY F. MANBECK, JR.

*Attesting Officer*

*Commissioner of Patents and Trademarks*